United States Patent [19]

Wallace

[11] 4,000,873

[45] Jan. 4, 1977

[54] MOUNTING FOR ROCK DRILLS

[75] Inventor: Trevor Evelyn Wallace, Sandton, Transvaal, South Africa

[73] Assignee: The Steel Engineering Company Limited, Roodepoort, South Africa

[22] Filed: Feb. 12, 1976

[21] Appl. No.: 657,537

[52] U.S. Cl. ..... 248/2; 173/38; 248/16

[51] Int. Cl.[2] ..... E21C 5/11; E21C 9/00; E21C 11/00

[58] Field of Search ..... 248/2, 16; 173/38, 43, 173/28; 182/2

[56] References Cited

UNITED STATES PATENTS

| | | | |
|---|---|---|---|
| 2,877,660 | 3/1959 | Rush | 182/2 UX |
| 3,149,694 | 9/1964 | Smithee | 182/2 |
| 3,181,623 | 5/1965 | Lindgren | 173/43 X |
| 3,481,409 | 12/1969 | Westerlund | 248/16 UX |
| 3,537,675 | 11/1970 | Cycowicz | 248/417 |

FOREIGN PATENTS OR APPLICATIONS

| | | | |
|---|---|---|---|
| 1,179,892 | 10/1964 | Germany | 173/43 |

*Primary Examiner*—J. Franklin Foss
*Attorney, Agent, or Firm*—Young & Thompson

[57] ABSTRACT

A known extendable and retractable mounting for rock drills is described comprising a drill feed leg, a vertical support, which may be mounted on a truck and a counter-balancing device for counterbalancing the drill during movement vertically from one drilling position to another. The new feature described consists in applying a turning moment to the vertical support by means of a spring, two springs or a fluid cylinder and piston arrangement. The turning moment counteracts a resultant force tending to move the feed leg sideways.

2 Claims, 6 Drawing Figures

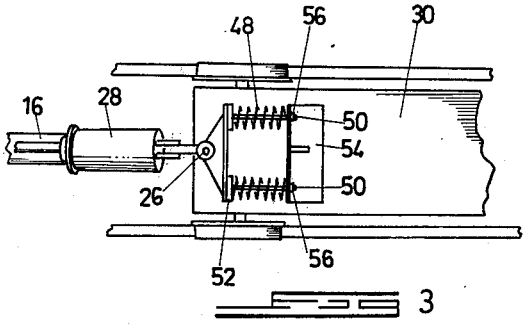
3
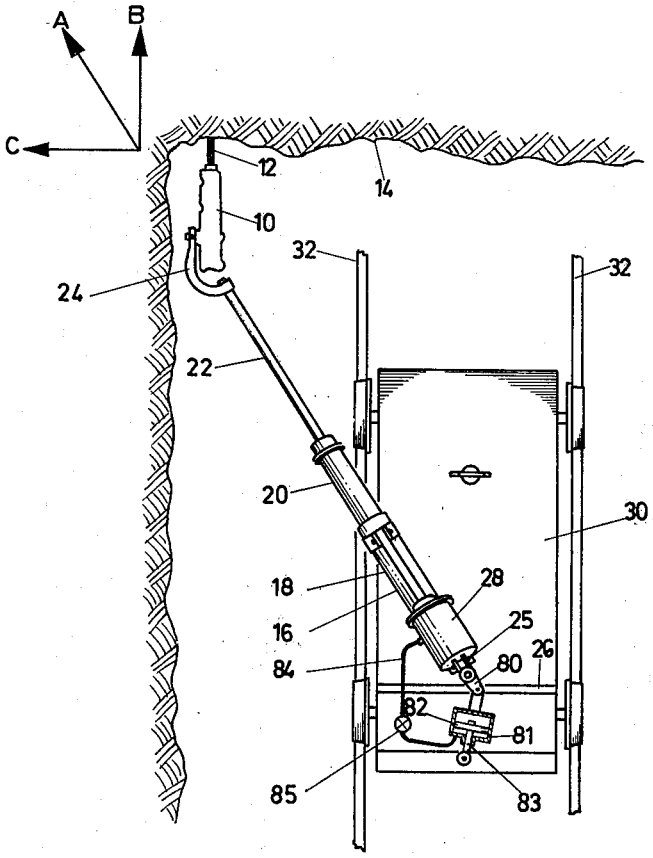
6

MOUNTING FOR ROCK DRILLS

This invention relates to a mounting for rock drills.

An extendable and retractable mounting for rock drills had already been proposed (see U.S. Pat. No. 3,185,223) which comprises a drill feed leg, a vertical support, which may be mounted on a truck, and a counterbalancing device for counterbalancing the drill during movement vertically from one drilling position to another. The rear part of the feed leg, the vertical support and the counterbalancing device form a triangle in a vertical plane, the one side of the triangle being adjustable to allow for up and down movement of the drill. The vertical support can also turn about its own vertical axis.

With the known proposal best results are achieved when the drill steel, rock drill and feed leg are all in line. However, it is not always possible to drill all holes in line. Many blasting patterns call for drill holes that do not radiate from a common point. When such holes are drilled, the feed leg applies a force to the rock drill which has a resultant tending to move the drilling point sideways off the intended drilling direction. In such cases collaring is specially difficult, but even during drilling the resultant causes problems.

According to the invention the known mounting is characterized by means for applying a bias about the axis to the assembly so that when the feed leg is used to either side of a central position, forces arising during drilling and tending to move the feed leg sideways further from the central position are counteracted.

The bias may be applied in a variety of ways. One such way is to use a spring or springs to apply a turning moment to the vertical support. Another way is to replace the spring or springs by a fluid thrustor or thrustors which applies or apply the turning moment to the vertical support. Still a further way is to tilt the axis about which the vertical support turns to such an extent that the triangle formed between the vertical support, the feed leg and the counterbalancing device is skewed out of a vertical plane so that the system has a gravitational bias.

Figure 1:
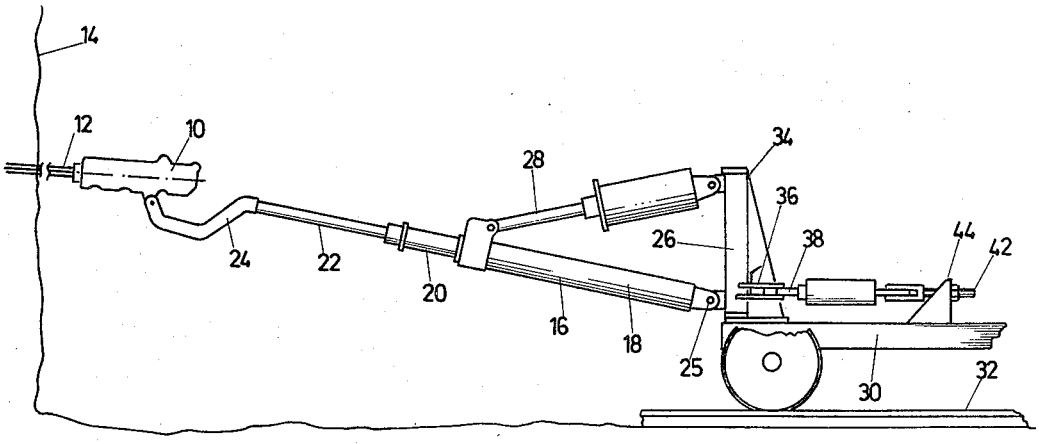
Figure 2:
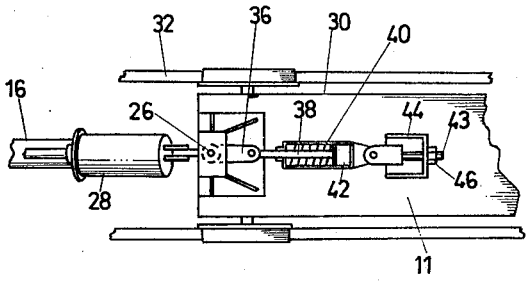
Figure 4:
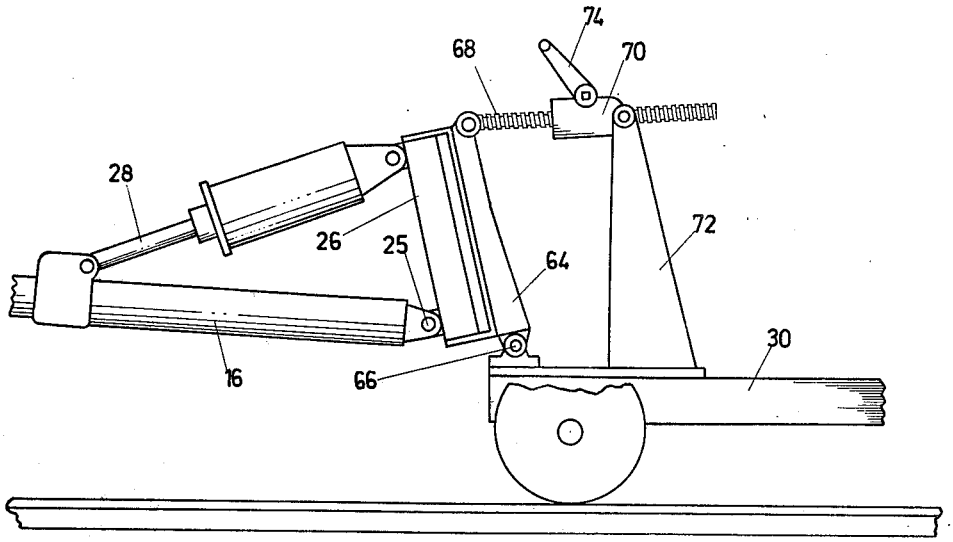
Figure 5:
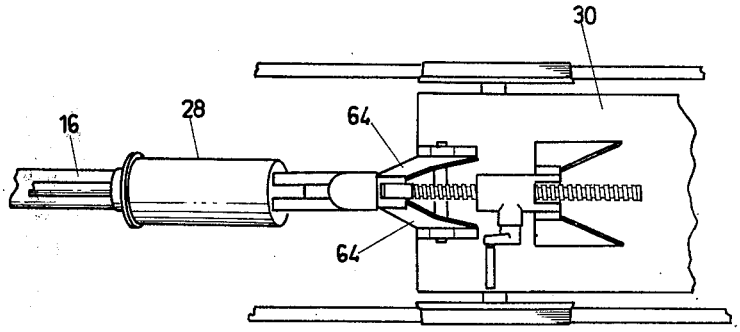

The invention is further discussed with reference to the accompanying drawings, in which FIG. 1 is a side elevation of an embodiment of the invention, FIG. 2 is a plan view of FIG. 1 with one part sectioned, FIG. 3 is a plan view of another embodiment, FIG. 4 is a view like FIG. 1 of yet another embodiment, FIG. 5 is a plan view of FIG. 5, and FIG. 6 is a plan view of the preferred embodiment.

In the drawings there is shown a mounting for a rock drill 10 having a drill steel 12, for drilling a rock face 14. The mounting comprises an extendable feed leg 16 having telescoping parts 18, 20, 22 that support the drill 10 through a goose neck 24. The feed leg 16 is pivoted about a horizontal pin 25 on a support 26. Pivotally connected between the support 26 and the feed leg 16 is a counterbalancing device 28 including a telexcoping piston and cylinder. The device 28 counterbalances vertical movement of the feed leg during drilling. The mounting is mounted on a truck 30 that is movable along rails 32.

In FIGS. 1 to 4 the support 26 is held vertical by a pillar 34 that is fixed to the front of the truck 30.

In FIGS. 1 and 2 the vertical support is fitted with projecting brackets 36 extending diametrally opposite to the feed leg 16. A rod 38 is pivoted to the brackets 36. The rod 38 is acted upon by a spring 40 contained in a housing 42 pivoted to a shaft 43 secured to fixed structure 44 mounted on the truck 30. The tension of the spring 40 is adjusted by means of a nut 46. Thus the vertical support has a centring bias applied to it by a spring thrustor.

As the assembly pivots off centre the spring 40 is more and more compressed and the centring bias increases. If the spring 40 is correctly chosen and adjusted, the bias will be sufficient to counteract the force that tends to move the drilling point sideways.

In FIG. 3 the single spring thrustor is replaced by a thrustor having two springs 48. Each spring 48 surrounds a shaft 50 which has a head 52 that compresses the spring 48 between itself and a structure 54 fixed to the truck 30. The compression of each spring is adjustable by means of a nut 56. Note that due to the fact that each spring 48 is secured between the head 52 and the structure 54 only one spring at a time exerts thrust as the device is turned.

The embodiment of FIGS. 4 and 5 does not use springs or any thrusting device. The vertical support 26 is mounted on a bracket 64 which can pivot on the truck 30 about a pivot pin 66. At the top, the bracket 64 is pivoted to a screwed strut 68. The strut 68 in turn engages with a screw operator 70 which is pivoted on a pillar 72 mounted on the truck 30. The operator 70 has a handle 74.

In this case the handle 74 is turned to add a bias to cancel forces that tend to push the drilling point off line. In effect a bias is effected by the gravitational components of the system that act beyond the lower pivot pin 66. In other words, when the bracket is tilted the feed leg 16 and counterbalancing device 28 tend to swing under gravity on the support 26 until they lie in the vertical plane containing the support 26. Thus the feed leg is urged by a centrallizing bias towards the longitudinal axis of the truck 30.

The preferred embodiment of the invention is illustrated in FIG. 6. In essence the spring of FIG. 2 is replaced by a fluid thrustor, which in this embodiment is a pneumatic thrustor. The support 26 has a lever arm 80 secured to it. Pivoted to the arm 80 is a cylinder 81. Inside the cylinder 81 is a piston 82 with a piston rod 83 which at its free end is pivoted to the truck 30. A pneumatic hose 84 from the rearward end (i.e. the end towards the support 26) of the cylinder 16 leads to the rear of the cylinder 81. A threeway valve 85 in the hose 84 can be used to connect the interior of the cylinder 16 to that of the cylinder 81 or to cut off the supply to the cylinder 81 while simultaneously exhausting that cylinder to atmosphere.

In FIG. 6 the forces acting on the system at the drilling end are shown. Firstly there is a force A in the direction of the axis of the part 22. This has a resultant B in the drilling direction and a resultant C at right angles which tends to force the drill off line. The purpose of the cylinder 81 and its associated parts is to counterbalance the force C. Exact counterbalancing is not always possible, but by a suitable choice of the diameter of the cylinder 81 in relation to the diameter of the cylinder 16, of the length of the arm 80 and the lengths of the cylinder 81 and the piston rod 83 one can achieve a satisfactory counterbalancing in practice.

If for some reason counterbalancing is not required, the cylinder 81 is inactivated by using the valve 85.

We claim:

1. A mounting for rock drills comprising a drill feed leg composed of a fluid operated piston and cylinder, a vertical support mounted for rotation about an axis, an adjustable counterbalancing arm, with the rear end of the feed leg, the support and the arm forming a triangle which can swing about an axis parallel to the vertical support and with the front end of the feed leg extending beyond the triangle and carrying a mount for a rock drill, so that the shape of the triangle changes as the mount is raised and lowered, a lever arm extending from the support, a fluid thrustor, the thrust of which can be regulated to counteract the forces tending to move the feed leg sideways, acting between the lever arm and fixed structure, and a common regulated fluid supply for the feed leg and the thrustor so that the bias exerted by the thrustor is proportional to the thrust applied by the feed leg.

2. The mounting claimed in claim 1 in which the length of the lever arm and the thrustor are so chosen that the bias exerted by the thrustor increases as the feed leg deviates from the central position.

* * * * *